United States Patent [19]

Izett et al.

[11] 4,140,318

[45] Feb. 20, 1979

[54] PUTTER-TYPE GOLF CLUB

[76] Inventors: George M. Izett; George G. Izett, both of 520 Glen Arbor Dr., Wynnewood, Pa. 19096

[21] Appl. No.: 789,240

[22] Filed: Apr. 20, 1977

[51] Int. Cl.[2] ..... A63B 53/04

[52] U.S. Cl. ..... 273/167 A; 273/167 G

[58] Field of Search ..... 273/77 R, 80 C, 164, 273/167–174, 80.1, 80.2, 81.3; D34/5 GC, 5 GH

[56] References Cited

U.S. PATENT DOCUMENTS

| | | | |
|---|---|---|---|
| D. 240,445 | 7/1976 | Becker | 273/167 G X |
| 1,617,090 | 2/1927 | Worthington | 273/167 A |
| 1,703,199 | 2/1929 | McClure | 273/167 G X |
| 1,705,250 | 3/1929 | Hincks | 273/167 G X |
| 1,866,615 | 7/1932 | Beckley | 273/167 A |
| 2,478,468 | 8/1949 | Drake | 273/167 G X |
| 3,079,157 | 2/1963 | Turner | 273/167 A |
| 3,085,804 | 4/1963 | Pieper | 273/168 |
| 3,567,227 | 3/1971 | Panks | 273/80 C X |
| 3,758,115 | 9/1973 | Hoglund | 273/167 G X |
| 4,000,902 | 1/1977 | Perkins | 273/167 A X |

*Primary Examiner*—Richard J. Apley
*Attorney, Agent, or Firm*—Melvin C. Flint

[57] ABSTRACT

A putter golf club wherein the upstanding shaft is in a vertical plane extending transversely through the club head and the sole of the club head is forwardly and upwardly inclined at an angle of about three degrees relative to a horizontal plane extending through the club head. When the club is held with the sole resting flat on the playing surface the grip at the top of the shaft will be ahead of the striking force of the club, promoting an inside back stroke.

4 Claims, 4 Drawing Figures

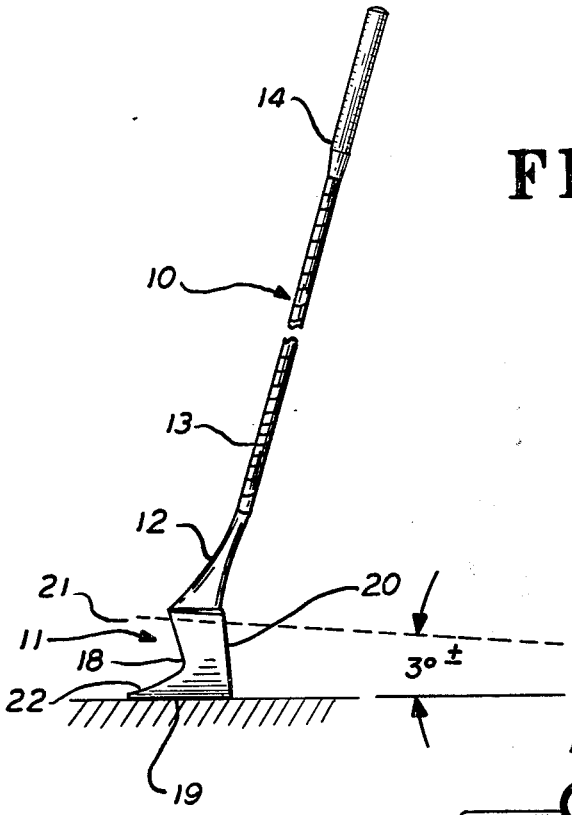
FIG. 1
FIG. 2
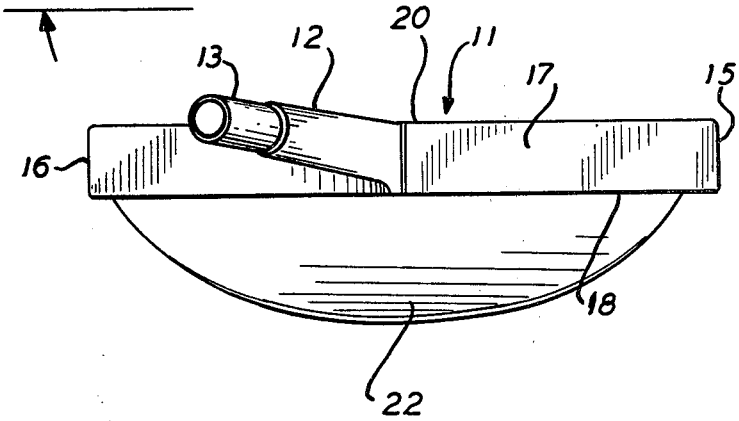
FIG. 3
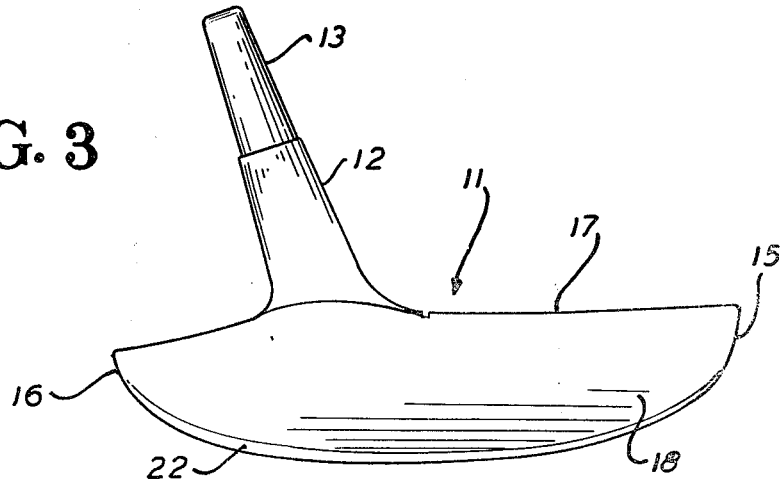

PUTTER-TYPE GOLF CLUB

BACKGROUND OF THE INVENTION

The present invention relates generally to the golf club art and more particularly to a putter golf club which is so constructed that when it is resting with the sole flat on the putting surface the grip at the top of the shaft will be somewhat ahead of the striking face of the club head.

SUMMARY OF THE INVENTION

It is an object of the present invention to provide a putter golf club which is constructed so that in use when addressing the ball the golfer's hands on the grip will be about two inches ahead of the club face which automatically makes for a slightly inside back stroke, thereby enabling the golfer to swing through on line to the target.

It is another object of the present invention to provide a putter golf club in which the sole of the club head is forwardly and upwardly inclined relative to a horizontal plane extending through the club head and the shaft is attached to the club head in a manner such that in use the grip will be about two inches ahead or forward of the striking face.

It is a further object of the present invention to provide a putter golf club of the type described which can be readily and relatively inexpensively manufactured.

The foregoing and other objects, features and advantages of the invention will be apparent from the following description of the invention taken in conjunction with the accompanying drawings.

BRIEF DESCRIPTION OF THE DRAWINGS

FIG. 1 is a front elevational view of a putter golf club constructed in accordance with the present invention, the club being oriented as if grounded, in normal play, immediately preparatory to use in making a putt with the sole of the club head substantially flat on the ground.

FIG. 2 is a fragmentary plan view, from above, of the putter of FIG. 1.

FIG. 3 is a fragmentary rear elevational view of the putter of FIG. 1.

DETAILED DESCRIPTION OF THE INVENTION

Figure 4:
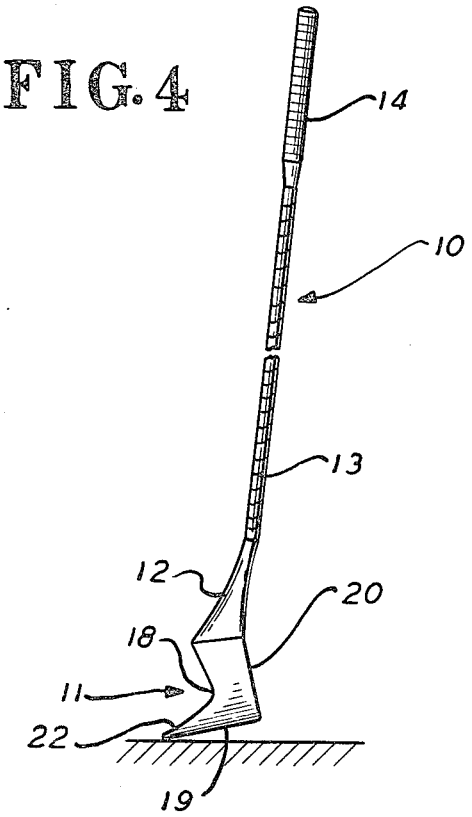
FIG. 4 is a front elevational view showing the putter prior to resting the sole flat on the ground.

Referring to the drawings, a putter golf club 10 is shown comprising an elongated club head 11, a hosel 12 having an axial channel, and a shaft 13 affixed at one end within the axial channel of the hosel 12 and is provided at the other end with a conventional grip 14 of leather, rubber or other suitable material. The club head 11 has a toe 15, heel 16, top surface 17, reverse side 18, sole 19, and striking face 20. The shaft 13 is inclined outwardly of heel 16 and is in an imaginary plane extending transversely through club head 11.

Sole 19 is inclined forwardly and upwardly at an angle of about three degrees relative to an imaginary horizontal plane 21 extending through the club head 11. When club 10 is grounded, in normal play, immediately preparatory to use in making a putt with the sole 19 substantially flat on the ground, the grip 14 of shaft 13 normally will be about 1¾ to 2¼ inches ahead of striking face 20. Thus, with the golfer's hands ahead of the ball when addressing it, the club head 11 almost automatically will follow an inside path during the back stroke which enables the golfer to go through the ball on line to the target.

In use when the golfer first places club 10 on the putting surface behind the ball, the club head 11 will normally face the left with toe 15 forward of heel 16. The golfer then moves grip 14 forward until striking face 20 becomes square to the line of play. In this position the golfer can more accurately propel the ball toward the target. In a preferred embodiment of this invention such alignment of striking face 20 is facilitated by providing ridge 22 on the lower edge of reverse side 18 of club head 11. Ridge 22 comprises an extension of sole 19 and the bottom side lies in the same plane as sole 19. It is to be understood that ridge 22 is not an essential feature of this invention.

Sole 19 of club head 11 may be flat. However, in a preferred embodiment of this invention sole 19 is cylindrically convex about a front-to-rear extending axis as clearly shown in FIG. 3, the radius of curvature of which preferably is about five inches. The convex configuration of sole 19 lessens the tendency of a lower forward corner of club head 11 to dig into the putting surface when a ball is putted.

It should be evident that various modifications can be made to the described embodiments without departing from the scope of the present invention.

We claim:

1. A putter golf club for use in putting comprising: (a) an elongated club having a toe and heel at opposite ends, a top surface, a reverse side, a sole, and a striking face on the leading side of said head somewhat inclined when the sole rests on the ground; (b) an elongated upstanding shaft having one end fixedly attached to the top surface of said head and having a grip mounted at the other end thereof, said shaft being spaced behind the striking face and being inclined outwardly of said heel substantially in an imaginary plane extending transversely through said head, and (c) said sole being forwardly and upwardly inclined to an extent such that when said club is held with said sole resting flat on the playing surface said grip will be in a position about 2 inches forwardly of said striking face and said sole further being flat in the transverse direction and extending from the rear surface to the leading edge of said head.

2. The putter golf club as set forth in claim 1 wherein said sole inclines forwardly and upwardly at an angle of about 3 degrees relative to a horizontal plane extending through said head.

3. The putter golf club as set forth in claim 1 wherein said sole is cylindrically convex about a front-to-rear extending axis, the radius of curvature of said convex sole being about 5 inches.

4. The putter golf club as set forth in claim 1 wherein the reverse side of said club head has disposed thereon an integral and continuous projecting ridge comprising an extension of said sole and located along the lower edge of said reverse side from said toe to said heel.

* * * * *